US009699574B2

(12) United States Patent
Gran et al.

(10) Patent No.: US 9,699,574 B2
(45) Date of Patent: Jul. 4, 2017

(54) METHOD OF SUPERIMPOSING SPATIAL AUDITORY CUES ON EXTERNALLY PICKED-UP MICROPHONE SIGNALS

(71) Applicant: GN Hearing A/S, Ballerup (DK)

(72) Inventors: Karl-Fredrik Johan Gran, Malmo (SE); Jesper Udesen, Malov (DK)

(73) Assignee: GN Hearing A/S, Ballerup (DK)

( * ) Notice: Subject to any disclaimer, the term of this patent is extended or adjusted under 35 U.S.C. 154(b) by 63 days.

(21) Appl. No.: 14/589,587

(22) Filed: Jan. 5, 2015

(65) Prior Publication Data

US 2016/0192090 A1 Jun. 30, 2016

(30) Foreign Application Priority Data

Dec. 30, 2014 (DK) ..... 2014 70835
Dec. 30, 2014 (EP) ..... 14200593

(51) Int. Cl.
*H04R 3/00* (2006.01)
*H04R 25/00* (2006.01)
*H04R 1/02* (2006.01)

(52) U.S. Cl.
CPC ..... *H04R 25/552* (2013.01); *H04R 25/407* (2013.01); *H04R 25/43* (2013.01); *H04R 25/554* (2013.01); *H04R 2225/43* (2013.01)

(58) Field of Classification Search
CPC .. H04R 25/552; H04R 25/554; H04R 25/407; H04R 2225/43

(Continued)

(56) References Cited

U.S. PATENT DOCUMENTS 8,391,522 B2 3/2013 Lotito et al.
8,718,302 B2 5/2014 Edwards et al.

(Continued)

FOREIGN PATENT DOCUMENTS

EP 1531650 A2 5/2005
EP 1691574 A2 8/2006

(Continued)

OTHER PUBLICATIONS

Extended European Search Report dated Jun. 26, 2015 for corresponding European Patent Application No. 14200593.3, 8 pages.

(Continued)

*Primary Examiner* — Vivian Chin
*Assistant Examiner* — Ammar Hamid
(74) *Attorney, Agent, or Firm* — Vista IP Law Group, LLP

(57) ABSTRACT

The present disclosure relates in a first aspect to a method of superimposing spatial auditory cues to an externally picked-up sound signal in a hearing instrument. The method comprises steps of a generating an external microphone signal by an external microphone arrangement and transmitting the external microphone signal to a wireless receiver of a first hearing instrument via a first wireless communication link. Further steps of the methodology comprise determining response characteristics of a first spatial synthesis filter by correlating the external microphone signal and a first hearing aid microphone signal of the first hearing instrument and filtering the external microphone signal by the first spatial synthesis filter to produce a first synthesized microphone signal comprising first spatial auditory cues.

19 Claims, 2 Drawing Sheets

(58) Field of Classification Search
USPC ..... 381/23.1, 312, 315
See application file for complete search history.

(56) References Cited

U.S. PATENT DOCUMENTS

| | | | | |
|---|---|---|---|---|
| 2002/0106094 | A1 | 8/2002 | Fujino | |
| 2012/0063610 | A1* | 3/2012 | Kaulberg | H04R 25/407 381/71.1 |
| 2013/0094683 | A1* | 4/2013 | Hansen | G09B 21/04 381/309 |

FOREIGN PATENT DOCUMENTS

| | | | |
|---|---|---|---|
| EP | 2584794 | A1 | 4/2013 |
| WO | WO 2008/144784 | A1 | 12/2008 |

OTHER PUBLICATIONS

First Technical Examination and Search Report dated Mar. 25, 2015, for corresponding Danish Patent Application No. PA 2014 70835, 8 pages.

* cited by examiner

METHOD OF SUPERIMPOSING SPATIAL AUDITORY CUES ON EXTERNALLY PICKED-UP MICROPHONE SIGNALS

RELATED APPLICATION DATA

This application claims priority to and the benefit of Danish Patent Application No. PA 2014 70835 filed on Dec. 30, 2014, pending, and European Patent Application No. 14200593.3 filed on Dec. 30, 2014, pending. The entire disclosures of both of the above applications are expressly incorporated by reference herein.

FIELD

The present disclosure relates in a first aspect to a method of superimposing spatial auditory cues to an externally picked-up sound signal in a hearing instrument. The method comprises steps of a generating an external microphone signal by an external microphone arrangement and transmitting the external microphone signal to a wireless receiver of a first hearing instrument via a first wireless communication link. Further steps of the methodology comprise determining response characteristics of a first spatial synthesis filter by correlating the external microphone signal and a first hearing aid microphone signal of the first hearing instrument and filtering the external microphone signal by the first spatial synthesis filter to produce a first synthesized microphone signal comprising first spatial auditory cues.

BACKGROUND

Hearing instruments or aids typically comprise a microphone arrangement which includes one or more microphones for receipt of incoming sound such as speech and music signals. The incoming sound is converted to an electric microphone signal or signals that are amplified and processed in a control and processing circuit of the hearing instrument in accordance with parameter settings of one or more preset listening program(s). The parameter settings for each listening program have typically been computed from the hearing impaired individual's specific hearing deficit or loss for example expressed in an audiogram. An output amplifier of the hearing instrument delivers the processed, i.e. hearing loss compensated, microphone signal to the user's ear canal via an output transducer such as a miniature speaker, receiver or possibly electrode array. The miniature speaker or receiver may be arranged inside housing or shell of the hearing instrument together with the microphone arrangement or arranged separately in an ear plug or earpiece of the hearing instrument.

A hearing impaired person typically suffers from a loss of hearing sensitivity which loss is dependent upon both frequency and the level of the sound in question. Thus a hearing impaired person may be able to hear certain frequencies (e.g., low frequencies) as well as a normal hearing person, but unable to hear sounds with the same sensitivity as a normal hearing individual at other frequencies (e.g., high frequencies). Similarly, the hearing impaired person may perceive loud sounds, e.g. above 90 dB SPL, with the same intensity as the normal hearing person, but still unable to hear soft sounds with the same sensitivity as the normal hearing person. Thus, in the latter situation, the hearing impaired person suffers from a loss of dynamic range at certain frequencies or frequency bands.

In addition to the above-mentioned frequency and level dependent hearing loss of the hearing impaired person loss often leads to a reduced ability to discriminate between competing or interfering sound sources for example in a noisy sound environment with multiple active speakers and/or noise sound sources. The healthy hearing system relies on the well-known cocktail party effect to discriminate between the competing or interfering sound sources under such adverse listening conditions. The signal-to-noise ratio (SNR) of sound at the listener's ears may be very low for example around 0 dB. The cocktail party effect relies inter alia on spatial auditory cues in the competing or interfering sound sources to perform the discrimination based on spatial localization of the competing sound sources. Under such adverse listening conditions, the SNR of sound received at the hearing impaired individual's ears may be so low that the hearing impaired individual is unable to detect and use the spatial auditory cues to discriminate between different sound streams from the competing sound sources. This leads to a severe worsened ability to hearing and understanding speech in noisy sound environments for many hearing impaired persons compared to normal hearing subjects.

Numerous prior art analog and digital hearing aids have been designed to mitigate the above-identified hearing deficiency in noisy sound environments. A common way of addressing the problem has been to apply SNR enhancing techniques to the hearing aid microphone signal(s) such as various types of fixed or adaptive beamforming to provide enhanced directionality. These techniques, whether based on wireless technology or not, have only been shown to have limited effect. With the introduction of wireless hearing aid technology and accessories, it has become possible to place an external microphone arrangement close to or on, i.e. via a belt or shirt clip, the target sound source in certain listening situations. The external microphone arrangement may for example be housed in portable unit which is arranged in the proximity of a speaker such as a teacher in a classroom environment. Due to the proximity of the microphone arrangement to the target sound source it is able to generate the external microphone signal with a target sound signal with significantly higher SNR than the SNR of the same target sound signal recorded/received at the hearing instrument microphone(s). The external microphone signal is transmitted to a wireless receiver of the left ear and/or right hearing instrument(s) via a suitable wireless communication link or links. The wireless communication link or links may be based proprietary or industry standard wireless technologies such as Bluetooth. The hearing instrument or instruments thereafter reproduces the external microphone signal with the SNR improved target sound signal to the hearing aid user's ear or ears via a suitable processor and output transducer.

However, the external microphone signal generated by such prior art external microphone arrangements lacks spatial auditory cues because of its distant or remote position in the sound field. This distant or remote position typically lies far away from the hearing aid user's head and ears for example more than 5 meters or 10 meters away. The lack of these spatial auditory cues during reproduction of the external microphone signal in the hearing instrument or instruments leads to an artificial and unpleasant internalized perception of the target sound source. The sound source appears to be placed inside the hearing aid user's head. Hence, it is advantageous to provide signal processing methodologies, hearing instruments and hearing aid systems capable of reproducing externally recorded or picked-up sound signals with appropriate spatial cues providing the hearing aid user or patient with a more natural sound perception. This problem has been addressed and solved by one or more embodiments described herein by generating and superimposing appropriate spatial auditory cues on a remotely recorded or picked-up microphone signal in connection with reproduction of the remotely picked-up microphone signal in the hearing instrument.

SUMMARY

A first aspect relates to a method of superimposing spatial auditory cues to an externally picked-up sound signal in a hearing instrument, comprising steps of:

a) generating an external microphone signal by an external microphone arrangement placed in a sound field in response to impinging sound, b) transmitting the external microphone signal to a wireless receiver of a first hearing instrument via a first wireless communication link, c) generating a first hearing aid microphone signal by a microphone arrangement of the first hearing instrument simultaneously with receiving the external microphone signal, wherein the first hearing instrument is placed in the sound field at, or in, a user's left or right ear, d) determining response characteristics of a first spatial synthesis filter by correlating the external microphone signal and the first hearing aid microphone signal, e) filtering, in the first hearing instrument, the received external microphone signal by the first spatial synthesis filter to produce a first synthesized microphone signal comprising first spatial auditory cues.

The present disclosure addresses and solves the above discussed prior art problems with artificial and unpleasant internalized perception of the target sound source when reproduced via the remotely placed external microphone arrangement instead of through the microphone arrangement of the first hearing aid or instrument. The determination of frequency response characteristics, or equivalently impulse response characteristics of the first spatial synthesis filter in accordance with some embodiments, allows appropriate spatial auditory cues to be added or superimposed to the received external microphone signal. These spatial auditory cues correspond largely to the auditory cues that would be generated by sound propagating from the true spatial position of the target sound source relative to the hearing user's head where the first hearing instrument is arranged. The proximity between the external microphone arrangement and the target sound source ensures the target sound signal typically possesses a significantly higher signal-to-noise ratio than the target sound picked-up by the microphone arrangement of the first hearing aid microphone signal. The microphone arrangement of the first hearing instrument is preferably housed within a housing or shell of the first hearing instrument such that this microphone arrangement is arranged at, or in, the hearing aid user's left or right ear as the case may be. The skilled person will understand that the first hearing instrument may comprise different types of hearing instruments such as so-called BTE types, ITE types, CIC types, RIC types etc. Hence, the microphone arrangement of the first hearing instrument may be located at various locations at, or in, the user's ear such as behind the user's pinnae, or inside the user's outer ear or inside the user's ear canal.

It is a significant advantage that the first spatial synthesis filter may be determined solely from the first hearing aid microphone signal and the external microphone signal without involving a second hearing aid microphone signal picked-up at the user's other ear. Hence, there is no need for binaural communication of the first and second hearing aid microphone signals between the first, or left ear, hearing instrument and the second, or right ear, hearing instrument. This type of direct communication between the first and second hearing instruments would require the presence of a wireless transmitter in at least one of the first and second hearing instruments leading to increased power consumption and complexity of the hearing instruments in question.

The present methodology preferably comprises further steps of:

f) processing the first synthesized microphone signal by a first hearing aid signal processor according to individual hearing loss data of the user to produce a first hearing loss compensated output signal of the first hearing instrument, g) reproducing the first hearing loss compensated output signal to the user's left or right ear through a first output transducer. The first output transducer may comprise a miniature speaker or receiver arranged inside the housing or shell of the first hearing instrument or arranged separately in an ear plug or earpiece of the first hearing instrument. Properties of the first hearing aid signal processor is discussed below.

Another embodiment of the present methodology comprises superimposing respective spatial auditory cues to the remotely picked-up sound signal for a left ear, or first, hearing instrument and a right ear, or second, hearing instrument. This embodiment is capable of generating binaural spatial auditory cues to the hearing impaired individual to exploit the advantages associated with binaural processing of acoustic signals propagating in the sound field such as the target sound of the target sound source. This binaural methodology of superimposing spatial auditory cues to the remotely picked-up sound signal comprises further steps of:

b1) transmitting the external microphone signal to a wireless receiver of a second hearing instrument via a second wireless communication link, c1) generating a second hearing aid microphone signal by a microphone arrangement of the second hearing instrument simultaneously with receiving the external microphone signal, wherein the second hearing instrument is placed in the sound field at, or in, a user's other ear, d1) determining response characteristics of a second spatial synthesis filter by correlating the external microphone signal and the second hearing aid microphone signal, e1) filtering, in the second hearing instrument, the received external microphone signal with the second spatial synthesis filter to produce a second synthesized microphone signal comprising second spatial auditory cues. This binaural methodology may comprise executing further steps of:

f1) processing the second synthesized microphone signal by a second hearing aid signal processor of the second hearing instrument according to the individual hearing loss data of the user to produce a second hearing loss compensated output signal of the second hearing instrument, g1) reproducing the second hearing loss compensated output signal to the user's other ear through a second output transducer.

In one embodiment of the present methodology, the step of processing the first synthesized microphone signal comprises:

mixing the first synthesized microphone signal and the first hearing aid microphone signal in a first ratio to produce the hearing loss compensated output signal. According to one such embodiment, the mixing of the first synthesized microphone signal and the first hearing aid microphone signal comprises varying the ratio between the first synthesized microphone signal and the first hearing aid microphone signal in dependence of a signal to noise ratio of the first microphone signal. Several advantages associated with this mixing of the first synthesized microphone signal and the first hearing aid microphone signal are discussed below in detail in connection with the appended drawings.

The skilled person will understand that there exist numerous way of correlating the external microphone signal and the first hearing aid microphone signal to determine of the response characteristics of the first spatial synthesis filter according to step d) and/or step d1) above. In one embodiment of the present methodology, the external microphone signal and the first hearing aid microphone signal are cross-correlated to determine a time delay between these signals. This embodiment additionally comprises a step of determining a level difference between the external microphone signal and the first hearing aid microphone signal based on the cross-correlation of the external microphone signal and the first hearing aid microphone signal, determining the response characteristics of the first spatial synthesis filter by multiplying the determined time delay and the determined level difference, The cross-correlation of the external microphone signal, $s_E(t)$, and the first hearing aid microphone signal, $s_L(t)$, may be carried out according to:

$$r_L(t)=s_E(t)\otimes s_L(-t);$$

The time delay, $\tau_L$, between the external microphone signal and the first hearing aid microphone signal is determined from the cross-correlation $r_L(t)$:

$$\tau_L=\arg\max_t r_L(t);$$

Determining the level difference, $A_L$, between the external microphone signal $s_E(t)$ and the first hearing aid microphone signal $s_L(t)$ may be carried out according to:

$$A_L=\sqrt{\frac{E[|r_L(t)|^2]}{E[|s_E(t)\otimes s_E(-t)|^2]}}$$

Finally, an impulse response $g_L(t)$ of the first spatial synthesis filter, representing the response characteristics of the first spatial synthesis filter, may be determined according to:

$$g_L(t)=A_L\delta(t-T_L)$$

The first synthesized microphone signal may be generated in the time domain from the impulse response $g_L(t)$ of the first spatial synthesis filter by a further step of:

a. convolving the external microphone signal with the impulse response of the first spatial synthesis filter. The skilled person will understand that the first synthesized microphone signal may be generated from a corresponding frequency response of the first spatial synthesis filter and a frequency domain representation of the external microphone signal for example by DFT or FFT representations of the first spatial synthesis filter and the external microphone signal.

In an alternative embodiment of the present methodology the correlation of the external microphone signal and the first hearing aid microphone signal to determine of the response characteristics of the first spatial synthesis filter according to step d) and/or step d1) above comprises:

determining an impulse response $g_L(t)$ of the first spatial synthesis filter according to:

$$g_L(t)=\underset{g(t)}{\operatorname{argmin}}\,E[|g(t)\otimes s_E(t)-s_L(t)|^2]$$

wherein $g_L(t)$ represents an impulse response of the first spatial synthesis filter.

A significant advantage of the latter embodiment is that the impulse response $g_L(t)$ of the first spatial synthesis filter can be computed in real-time as a corresponding adaptive filter by a suitably configured or programmed signal processor of the first hearing instrument and/or the second hearing instrument for the second spatial synthesis filter. The solution of $g_L(t)$ may comprise adaptively filtering the external microphone signal by a first adaptive filter to produce the first synthesized microphone signal as an output of the adaptive filter and subtracting the first synthesized microphone signal outputted by the first adaptive filter from the first hearing aid microphone signal to produce an error signal, adapting filter coefficients of the first adaptive filter according to a predetermined adaptive algorithm to minimize the error signal. These adaptive filter based embodiments of the first spatial synthesis filter are discussed below in detail in connection with the appended drawings.

A second aspect relates to a hearing aid system comprising a first hearing instrument and a portable external microphone unit. The portable external microphone unit comprises:

a microphone arrangement for placement in a sound field and generation of an external microphone signal in response to impinging sound, a first wireless transmitter configured to transmit the external microphone signal via a first wireless communication link. The first hearing instrument of the hearing aid system comprises:

a hearing aid housing or shell configured for placement at, or in, a user's left or right ear, a first wireless receiver configured for receiving the external microphone signal via the first wireless communication link, a first hearing aid microphone configured for generating a first hearing aid microphone signal in response to sound simultaneously with the receipt of the external microphone signal, a first signal processor configured to determining response characteristics of a first spatial synthesis filter by correlating the external microphone signal and the first hearing aid microphone signal. The first signal processor is further configured to filtering the received external microphone signal by the first spatial synthesis filter to produce a first synthesized microphone signal comprising first spatial auditory cues.

As discussed above, the hearing aid system may be configured for binaural use and processing of the external microphone signal such that the first hearing instrument is arranged at, or in, the user's left or right ear and the second hearing instrument placed at, or in, the user's other ear. Hence, the hearing aid system may comprise the second hearing instrument which comprises:

a second hearing aid housing or shell configured for placement at, or in, the user's other ear, a second wireless receiver configured for receiving the external microphone signal via a second wireless communication link, a second hearing aid microphone configured for generating a second hearing aid microphone signal in response to sound simultaneously with the receipt of the external microphone signal, a second signal processor configured to determining response characteristics of a second spatial synthesis filter by correlating the external microphone signal and the second hearing aid microphone signal, wherein the second signal processor is further configured to filtering the received external microphone signal by the second spatial synthesis filter to produce a second synthesized microphone signal comprising second spatial auditory cues.

Signal processing functions of the each of the first and/or second signal processors may be executed or implemented by dedicated digital hardware or by one or more computer programs, program routines and threads of execution running on a software programmable signal processor or processors. Each of the computer programs, routines and threads of execution may comprise a plurality of executable program instructions. Alternatively, the signal processing functions may be performed by a combination of dedicated digital hardware and computer programs, routines and threads of execution running on the software programmable signal processor or processors. Each of the above-mentioned methodologies of correlating the external microphone signal and the second hearing aid microphone signal may be carried out by a computer program, program routine or thread of execution executable on a suitable software programmable microprocessor such as a programmable Digital Signal Processor. The microprocessor and/or the dedicated digital hardware may be integrated on an ASIC or implemented on a FPGA device. Likewise, the filtering of the received external microphone signal by the first spatial synthesis filter may be carried out by a computer program, program routine or thread of execution executable on a suitable software programmable microprocessor such as a programmable Digital Signal Processor. The software programmable microprocessor and/or the dedicated digital hardware may be integrated on an ASIC or implemented on a FPGA device.

Each of the first and second wireless communication links may be based on RF signal transmission of the external microphone signal to the first and/or second hearing instruments, e.g. analog FM technology or various types of digital transmission technology for example complying with a Bluetooth standard, such as Bluetooth LE or other standardized RF communication protocols. In the alternative, each of the first and second wireless communication links may be based on optical signal transmission. The same type of wireless communication technology is preferably used for the first and second wireless communication links to minimize system complexity.

A method of superimposing spatial auditory cues to an externally picked-up sound signal in a hearing instrument, includes: receiving, via a first wireless communication link, an external microphone signal from an external microphone placed in a sound field, wherein the act of receiving is performed using a wireless receiver of a first hearing instrument; generating a first hearing aid microphone signal by a microphone system of the first hearing instrument, wherein the first hearing instrument is placed at, or in, a left ear or a right ear of a user; determining a response characteristic of a first spatial synthesis filter by correlating the external microphone signal and the first hearing aid microphone signal; and filtering, in the first hearing instrument, the received external microphone signal by the first spatial synthesis filter to produce a first synthesized microphone signal comprising first spatial auditory cues.

Optionally, the microphone system may include one or more microphones.

Optionally, the method further includes: processing the first synthesized microphone signal by a first signal processor according to individual hearing loss data of the user to produce a first hearing loss compensated output signal of the first hearing instrument; and presenting the first hearing loss compensated output signal to the user's left ear or right ear through a first output transducer.

Optionally, the method further includes: receiving, via a second wireless communication link, the external microphone signal, wherein the act of receiving the external microphone signal via the second wireless communication link is performed using a wireless receiver of a second hearing instrument; generating a second hearing aid microphone signal by a microphone system of the second hearing instrument when the external microphone signal is received by the second hearing instrument, wherein the first hearing instrument and the second hearing instrument are placed at, or in, the left ear and the right ear, respectively, or vice versa; determining a response characteristic of a second spatial synthesis filter by correlating the external microphone signal and the second hearing aid microphone signal; and filtering, in the second hearing instrument, the received external microphone signal by the second spatial synthesis filter to produce a second synthesized microphone signal comprising second spatial auditory cues.

Optionally, the act of processing the first synthesized microphone signal comprises mixing the first synthesized microphone signal and the first hearing aid microphone signal in a first ratio to produce the hearing loss compensated output signal.

Optionally, the method further includes varying the ratio between the first synthesized microphone signal and the first hearing aid microphone signal in dependence of a signal to noise ratio.

Optionally, the act of determining the response characteristic comprises: cross-correlating the external microphone signal and the first hearing aid microphone signal to determine a time delay between the external microphone signal and the first hearing aid microphone signal; determining a level difference between the external microphone signal and the first hearing aid microphone signal based on a result from the act of cross-correlating; and determining the response characteristic of the first spatial synthesis filter by multiplying the determined time delay and the determined level difference.

Optionally, the act of cross-correlating the external microphone signal and the first hearing aid microphone signal comprises determining $r_L(t)$ according to:

$$r_L(t)=s_E(t)\otimes s_L(-t),$$

wherein $s_E(t)$ represents the external microphone signal, and $s_L(t)$ represents the first hearing aid microphone signal; the time delay between the external microphone signal and the first hearing aid microphone signal is determined according to:

$$\tau_L=\arg\max_t r_L(t),$$

wherein $\tau_L$ represents the time delay; the act of determining the level difference between the external microphone signal $s_E(t)$ and the first hearing aid microphone signal $s_L(t)$ is performed according to:

$$A_L=\sqrt{\frac{E[|r_L(t)|^2]}{E[|s_E(t)\otimes s_E(-t)|^2]}};$$

wherein $A_L$ represents the level difference; and wherein the act of determining the response characteristic comprises determining an impulse response $g_L(t)$ of the first spatial synthesis filter according to:

$$g_L(t)=A_L\delta(t-T_L).$$

Optionally, the first synthesized microphone signal is produced also by convolving the external microphone signal with an impulse response of the first spatial synthesis filter.

Optionally, the act of determining the response characteristic comprises: determining an impulse response $g_L(t)$ of the first spatial synthesis filter according to:

$$g_L(t) = \underset{g(t)}{\operatorname{argmin}} E[|g(t) \otimes s_E(t) - s_L(t)|^2]$$

wherein $g_L(t)$ represents the impulse response of the first spatial synthesis filter, $s_E(t)$ represents the external microphone signal, and $s_L(t)$ represents the first hearing aid microphone signal.

Optionally, the method further includes: subtracting the first synthesized microphone signal from the first hearing aid microphone signal to produce an error signal; and determining a filter coefficient for the first adaptive filter according to a predetermined adaptive algorithm to minimize the error signal.

Optionally, the first hearing aid microphone signal is generated by the microphone system of the first hearing instrument when the external microphone signal is received from the external microphone.

A hearing aid system includes a first hearing instrument; and a portable external microphone unit. The portable external microphone unit includes: a microphone for placement in a sound field and for generating an external microphone signal, and a first wireless transmitter configured to transmit the external microphone signal via a first wireless communication link. The first hearing instrument includes: a hearing aid housing or shell configured for placement at, or in, a left ear or a right ear of a user, a first wireless receiver configured for receiving the external microphone signal via the first wireless communication link, a first hearing aid microphone configured for generating a first hearing aid microphone signal in response to sound when the external microphone signal is being received by the first wireless receiver, and a first signal processor configured to determine a response characteristic of a first spatial synthesis filter by correlating the external microphone signal and the first hearing aid microphone signal, wherein the first spatial synthesis filter is configured to filter the received external microphone signal to produce a first synthesized microphone signal comprising first spatial auditory cues.

Optionally, the hearing aid system further includes a second hearing instrument, wherein said second hearing instrument comprises: a second hearing aid housing or shell, a second wireless receiver configured for receiving the external microphone signal via a second wireless communication link, a second hearing aid microphone configured for generating a second hearing aid microphone signal when the external microphone signal is being received by the second wireless receiver, and a second signal processor configured to determine a response characteristic of a second spatial synthesis filter based on the external microphone signal and the second hearing aid microphone signal, wherein the second spatial synthesis filter is configured to filter the received external microphone signal to produce a second synthesized microphone signal comprising second spatial auditory cues.

Other features, embodiments, and advantageous will be described below in the detailed description.

BRIEF DESCRIPTION OF THE DRAWINGS

Embodiments will be described in more detail in connection with the appended drawings in which.

DETAILED DESCRIPTION

Figure 1:
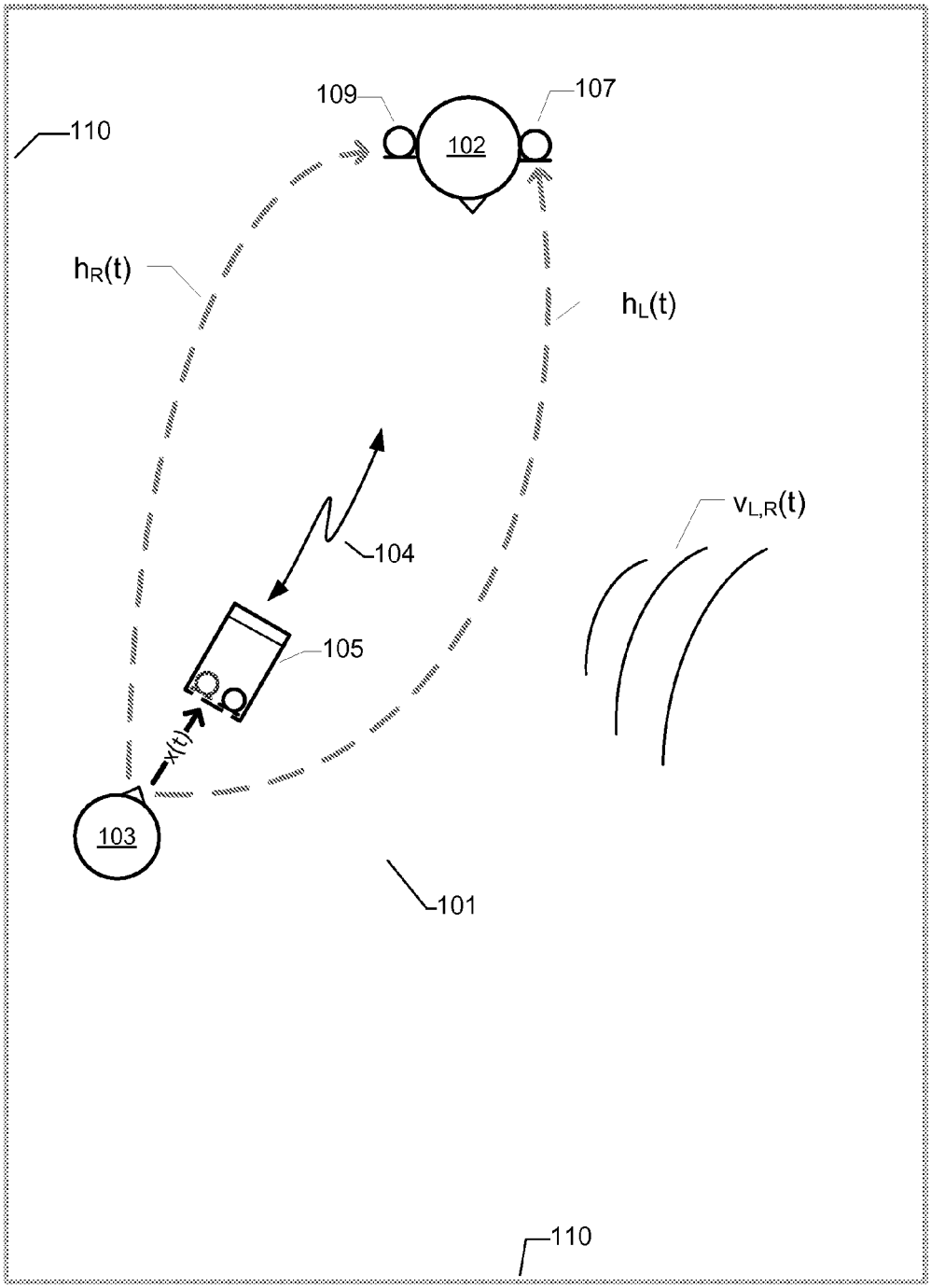
FIG. 1 is a schematic block diagram of a hearing aid system comprising left and right ear hearing instruments communicating with an external microphone arrangement via wireless communication links in accordance with a first embodiment.

Various embodiments are described hereinafter with reference to the figures. Like reference numerals refer to like elements throughout. Like elements will, thus, not be described in detail with respect to the description of each figure. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

FIG. 1 is a schematic illustration of a hearing aid system in accordance with a first embodiment operating in an adverse sound or listening environment. The hearing aid system 101 comprises an external microphone arrangement mounted within a portable housing structure of a portable external microphone unit 105. The external microphone arrangement may comprise one or more separate omnidirectional or directional microphones. The portable housing structure 105 may comprise a rechargeable battery package supplying power to the one or more separate microphones and further supplying power to various electronic circuits such as digital control logic, user readable screens or displays and a wireless transceiver (not shown). The external microphone arrangement may comprise a spouse microphone, clip microphone, a conference microphone or form part of a smartphone or mobile phone.

The hearing aid system 101 comprises a first hearing instrument or aid 107 mounted in, or at, a hearing impaired individual's right or left ear and a second hearing instrument or aid 109 mounted in, or at, the hearing impaired individual's other ear, Hence, the hearing impaired individual 102 is binaurally fitted with hearing aids in the present exemplary embodiment such that a hearing loss compensated output signal is provided both the left and right ear. The skilled person will understand that different types of hearing instruments such as so-called BTE types, ITE types, CIC types etc., may be utilized depending on factors such as the size of the hearing impaired individual's hearing loss, personal preferences and handling capabilities.

Each of the first and second hearing instruments 107, 109 comprises a wireless receiver or transceiver (not shown) allowing each hearing instrument to receive a wireless signal or data, in particular the previously discussed external microphone signal transmitted from the portable external microphone unit 105. The external microphone signal may be modulated and transmitted as an analog signal or as a digitally encoded signal via the wireless communication link 104. The wireless communication link may be based on RF signal transmission, e.g. FM technology or digital transmission technology for example complying with a Bluetooth standard or other standardized RF communication protocols.

In the alternative, the wireless communication link 10 may be based on optical signal transmission.

The hearing impaired individual 102 wishes to receive sound from the target sound source 103 which is a particular speaker placed on some distance away from the hearing impaired individual 102 outside the latter's median plane. As schematically illustrated by an interfering noise sound $v_{L,R}(t)$, the sound environment surrounding the hearing impaired individual 102 is adverse with a low SNR at the respective microphones of the first and second hearing instruments 107, 109. The interfering noise sound $v_{L,R}(t)$ may in practice comprises many different types of common noise mechanisms or sources such as competing speakers, motorized vehicles, wind noise, babble noise, music etc. The interfering noise sound $v_{L,R}(t)$ may in addition to direct noise sound components from the various noise sources also comprise various boundary reflections from room boundaries such as walls, floors and ceiling of a room 110 where the hearing impaired individual 102 is placed. Hence, the noise sources will often produce noise sound components from multiple spatial directions at the hearing impaired individual's ears making the sound field in the room 110 very challenging for understanding speech of the target speaker 103 without assistance from the external microphone arrangement.

A first linear transfer function between the target speaker 103 and the first hearing instrument 107 is schematically illustrated by dotted line $h_L(t)$ and a second linear transfer function between the target speaker 103 and the second hearing instrument 109 is likewise schematically illustrated by a second dotted line $h_R(t)$. The first and second transfer functions $h_L(t)$ and $h_R(t)$ may be represented by their respective impulse responses or by their respective frequency responses due to the Fourier transform equivalence. The first and second linear transfer functions describe the sound propagation from the target speaker or talker 103 to the right and left microphones, respectively, of the first/right and left/second hearing instruments.

The acoustic or sound signal picked-up by the microphone 107 of the first hearing instrument produces a first hearing aid microphone signal denoted $s_L(t)$ and the acoustic or sound signal picked-up by the microphone 109 of the right ear hearing instrument produces a second hearing aid microphone signal denoted $s_R(t)$) in the following. The noise sound signal at the microphone 109 of the right hearing instrument is denoted $v_R(t)$ and the noise sound signal at the microphone 107 of the left hearing instrument is denoted $v_L(t)$ in the following. The target speech signal produced by the target speaker 103 is denoted x(t) in in the following. Furthermore, based on the assumption that the each of hearing aid microphones 107, 109 pick up a noisy version of the target speech signal x(t) which has undergone a linear transformation we can write:

$$s_L(t)=h_L(t)\otimes x(t)+v_L(t) \tag{1}$$

$$s_R(t)=h_R(t)\otimes x(t)+v_R(t) \tag{2}$$

where $\otimes$ is the convolution operator.

At the same time the noisy infected or polluted versions of the target speech signal is received at the left and right hearing instrument microphones, the target speech signal x(t) is recorded or received at the external microphone arrangement:

$$s_E(t)=x(t)+v_E(t) \tag{3}$$

where $v_E(t)$ is the noise sound signal at the external microphone.

Furthermore, it is assumed that the target speech component of the external microphone signal picked-up by the external microphone arrangement is dominant such that power of the target speech signal is much larger than power of the noise sound signal, i.e.:

$$E[x^2(t)]>>E[v_E^2(t)] \tag{4}$$

The present embodiment of the methodology of deriving and superimposing spatial auditory cues onto the external microphone signal picked-up by the external microphone arrangement of the portable external microphone unit 105 in each of the left and right ear hearing instruments preferably comprises steps of:

1) Auditory spatial cue estimation
2) Auditory spatial cue synthesizer; and, optionally
3) Signal mixing.

According to one such embodiment of the present methodology, the auditory spatial cue determination or estimation comprises a time delay estimator and a signal level estimator. The first step comprises cross correlating the external microphone signal $s_E(t)$ with each of the first or the second hearing aid microphone signals according to:

$$r_L(t)=s_E(t)\otimes s_L(-t) \tag{5a}$$

$$r_R(t)=s_E(t)\otimes s_R(-t) \tag{5b}$$

the time delay for the right and left microphone signals $s_R(t)$, $s_L(t)$ is determined by:

$$\tau_L=\arg\max_t r_L(t) \tag{6a}$$

$$\tau_R=\arg\max_t r_R(t) \tag{6b}$$

and the level difference $A_L$, $A_R$ between the external microphone signal and each of the left and right microphone signals $s_L(t)$, $s_R(t)$ is determined according to:

$$A_L=\sqrt{\frac{E[|r_L(t)|^2]}{E[|s_E(t)\otimes s_E(-t)|^2]}} \tag{7a}$$

$$A_R=\sqrt{\frac{E[|r_R(t)|^2]}{E[|s_E(t)\otimes s_E(-t)|^2]}} \tag{7b}$$

In the second step, the impulse response of a left spatial synthesis filter for application in the left hearing instrument and the impulse response of a right spatial synthesis filter for application in the right hearing instrument are derived as:

$$g_L(t)=A_L\delta(t-\tau_L) \tag{8a}$$

$$g_R(t)=A_R\delta(t-\tau_R) \tag{8b}$$

In the left hearing instrument, the computed impulse response $g_L(t)$ of the left spatial synthesis filter is used to produce a first synthesized microphone signal $y_L(t)$ with superimposed or added first spatial auditory cues according to:

$$y_L(t)=g_L(t)\otimes s_E(t) \tag{9a}$$

In the right hearing instrument, the computed impulse response $g_L(t)$ of the right spatial synthesis filter is used in a corresponding manner to produce a second synthesized microphone signal $y_R(t)$ with superimposed or added second spatial auditory cues according to:

$$y_R(t)=g_R(t)\otimes s_E(t) \tag{9(b)}$$

Consequently, the first synthesized microphone signal $y_L(t)$ is produced by convolving the impulse response $g_L(t)$ of the left spatial synthesis filter with the external microphone signal $s_E(t)$ received by the left hearing instrument via the wireless communication link 104. The above-mentioned computations of the functions $r_L(t)$, $A_L$, $g_L(t)$ and $y_L(t)$ are preferably performed by a first signal processor of the left hearing instrument. The first signal processor may comprise a microprocessor and/or dedicated digital computational hardware for example comprising a hard-wired Digital Signal Processor (DSP). In the alternative, the first signal processor may comprise a software programmable DSP or a combination of dedicated digital computational hardware and the software programmable DSP. The a software programmable DSP may be configured to perform the above-mentioned computations by suitable program routines or threads each comprising a set of executable program instructions stored in a non-volatile memory device of the hearing instrument. The second synthesized microphone signal $y_R(t)$ is produced in a corresponding manner by convolving the impulse response $g_R(t)$ of the right spatial synthesis filter with the external microphone signal $s_E(t)$ received by the right hearing instrument via the wireless communication link 104 and proceeding in corresponding manner to the signal processing in the left hearing instrument.

The skilled person will understand that each of the above-mentioned microphone signals and impulse responses in the left and right hearing instruments preferably are represented in the digital domain such that the computational operations to produce the functions $r_L(t)$, $A_L$, $g_L(t)$ and $y_L(t)$ are executed numerically on digital signals by the previously discussed types of Digital Signal Processors. Each of the first synthesized microphone signal $y_L(t)$, the first hearing aid microphone signal $s_L(t)$ and the external microphone signal $s_E(t)$ may be a digital signal for example sampled at a sampling frequency between 16 kHz and 48 kHz.

The first synthesized microphone signal is preferably further processed by the first hearing aid signal processor to adapt characteristics of a hearing loss compensated output signal to the individual hearing loss profile of the hearing impaired user's left ear. The skilled person will appreciate that this further processing may include numerous types of ordinary and well-known signal processing functions such as multi-band dynamic range compression, noise reduction etc. After being subjected to this further processing, the first synthesized microphone signal is reproduced to the hearing impaired person's left ear as the hearing loss compensated output signal via the first output transducer. The first (and also second) output transducer may comprise a miniature speaker, receiver or possibly an implantable electrode array for cochlea implant hearing aids. The second synthesized microphone signal may be processed in a corresponding manner by the signal processor of the second hearing instrument to produce a second synthesized microphone signal and reproducing the same to the hearing impaired person's right ear.

Consequently, the external microphone signal picked-up by the remote microphone arrangement housed in the portable external microphone unit 105 is presented to the hearing impaired person's left and right ears with appropriate spatial auditory cues corresponding to the spatial cues that would have existed in the hearing aid microphone signals if the target speech signal produced by the target speaker 103 at his or hers actual position in the listening room was conveyed acoustically to the left and right ear microphones 109, 107 of the hearing instruments. This feature solves the previously discussed problems associated with the artificial and internalized perception of the target sound source inside the hearing aid user's head in connection with reproduction of remotely picked-up microphone signals in prior art hearing aid systems.

According to one embodiment of the present methodology, the first hearing loss compensated output signal does not exclusively include the first synthesized microphone signal, but also comprises a component of the first hearing aid microphone signal recorded by the first hearing aid microphone or microphones such that a mixture of these different microphone signals are presented to the left ear of the hearing impaired individual. According to the latter embodiment, the step of processing the first synthesized microphone signal $y_L(t)$ comprises:

mixing the first synthesized microphone signal $y_L(t)$ and the first hearing aid microphone signal $s_L(t)$ in a first ratio to produce the left hearing loss compensated output signal $z_L(t)$.

The mixing of the first synthesized microphone signal $y_L(t)$ and the first hearing aid microphone signal $s_L(t)$ may for example be implemented according to:

$$z_L(t)=bs_L(t)+(1-b)y_L(t) \tag{10}$$

where b is a decimal number between 0 and 1 which controls the mixing ratio.

The mixing feature may be exploited to adjust the relative level of the "raw" or unprocessed microphone signal and the external microphone signal such that the SNR of the left hearing loss compensated output signal can be adjusted. The inclusion of a certain component of the first hearing aid microphone signal $s_L(t)$ in the left hearing loss compensated output signal $z_L(t)$ is advantageous in many circumstances. The presence of a component or portion of the first hearing aid microphone signal $s_L(t)$ supplies the hearing impaired person with a beneficial amount of "environmental awareness" where other sound sources of potential interest than the target speaker becomes audible. The other sound sources of interest could for example comprise another person or a portable communication device sitting next to the hearing impaired person.

In a further advantageous embodiment, the ratio between the first synthesized microphone signal and the first hearing aid microphone signal $s_L(t)$ is varied in dependence of a signal to noise ratio of first hearing aid microphone signal $s_L(t)$. The signal to noise ratio of the first hearing aid microphone signal $s_L(t)$ may for example be estimated based on certain target sound data derived from the external microphone signal $s_E(t)$. The latter microphone signal is assumed to mainly or entirely be dominated by the target sound source, e.g. the target speech discussed above, and may hence be used to detect the level of target speech present in the first hearing aid microphone signal $s_L(t)$. The mixing feature according to equation (10) above may be implemented such that b is close to 1, when the signal to noise ratio of first hearing aid microphone signal $s_L(t)$ is high and b approaches 0 when the signal to noise ratio of first hearing aid microphone signal $s_L(t)$ is low. The value of b may for example be larger than 0.9 when the signal to noise ratio of first hearing aid microphone signal $s_L(t)$ is larger than 10 dB. In the opposite sound situation the value of b may for example be smaller than 0.1 when the signal to noise ratio of first hearing aid microphone signal $s_L(t)$ is smaller than 3 dB or 0 dB.

According to yet another embodiment of the present methodology, the estimation or computation of the auditory spatial cues comprises a direct or on-line estimation of the impulse responses of the left and/or right spatial synthesis filter $g_L(t)$, $g_R(t)$ that describe or model the linear transfer functions between the target sound source and the left ear and right ear hearing aid microphones, respectively.

According to this on-line estimation procedure, the computation or estimation of the impulse response of the first or left ear spatial synthesis filter is preferably accomplished by solving the following optimization problem or equation:

$$g_L(t)=\arg\min_{g(t)} E[|g(t)\otimes s_E(t)-s_L(t)|^2] \quad (11)$$

The skilled person will understand that the external microphone signal $s_E(t)$ can reasonably be assumed to be dominated by the target sound signal (because of the proximity between the external microphone arrangement and the target sound source). This assumption implies that the only way to minimize the error of equation (11) (and correspondingly the error of equation (12) below) is to completely remove the target sound signal or component from the first hearing aid microphone signal $s_L(t)$. This is accomplished by choosing the response of the filter g(t) to match the first linear transfer function $h_L(t)$ between the target sound source or speaker 103 and the first hearing instrument 107. This reasoning is based on the assumption that the target sound signal is uncorrelated with the interfering noise sound $v_{L,R}(t)$. Experience shows that this generally is a valid assumption in numerous real-life sound environments.

Hence, the computation or estimation of the impulse response of the second or right ear spatial synthesis filter is likewise preferably accomplished by solving the following optimization problem or equation:

$$g_R(t)=\arg\min_{g(t)} E[|g(t)\otimes s_E(t)-s_R(t)|^2] \quad (12)$$

Figure 2:
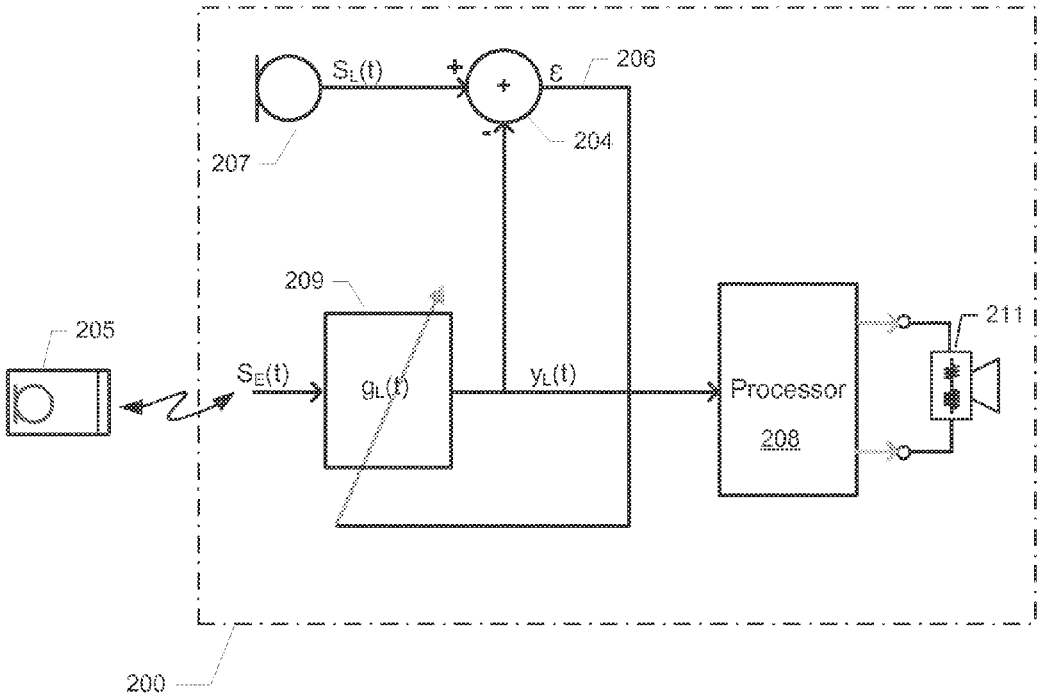
FIG. 2 is a schematic block diagram illustrating an adaptive filter solution for real-time adaptive computation of filter coefficients of a first spatial synthesis filter of the left or right ear hearing instrument.

Each of these computations of $g_L(t)$ and $g_R(t)$ can be accomplished in real time by applying an efficient adaptive algorithm such as Least Mean Square (LMS) or Recursive Least Square (RLS). This solution is illustrated by FIG. 2 which shows a simplified schematic block diagram of how the above-mentioned optimization equation (11) can be solved in real-time in the signal processor of the schematically illustrated left hearing instrument 200 using an adaptive filter 209. A corresponding solution may of course be applied in a corresponding right left hearing instrument (not shown).

The external microphone signal $s_E(t)$ is received by the previously discussed wireless receiver (not shown) decoded and possibly converted to a digital format if received in analog format. The digital external microphone signal $s_E(t)$ is applied to an input of the adaptive filter 209 and filtered by a current transfer function/impulse response of the adaptive filter 209 to produce a first synthesized microphone signal $y_L(t)$ at an output of the adaptive filter. The first hearing aid microphone signal $s_L(t)$ is substantially simultaneously applied to a first input of a subtractor 204 or subtraction function 204. The first, or left ear, synthesized microphone signal $y_L(t)$ is applied to a second input of a subtractor 204 such that the latter produces an error signal $\epsilon$ on signal line 206 which represents a difference between $y_L(t)$ and $s_L(t)$. The error signal $\epsilon$ is applied to an adaptive control input of the adaptive filter 209 via the signal line 206 in a conventional manner such that the filter coefficients of the adaptive filter are adjusted to minimize the error signal $\epsilon$ in accordance with the particular adaptive algorithm implemented by the adaptive filter 209. Hence, the first, or left ear, spatial synthesis filter is formed by the adaptive filter 209 which makes a real-time adaptive computation of filter coefficients $g_L(t)$.

Overall, the digital external microphone signal $s_E(t)$ is filtered by the adaptive transfer function of the adaptive filter 209 which in turn represents the left ear spatial synthesis filter, to produce the left ear synthesized microphone signal $y_L(t)$ comprising the first spatial auditory cues. The filtration of the digital external microphone signal $s_E(t)$ by the adaptive transfer function of the adaptive filter 209 may carried out as a discrete time convolution between the adaptive filter coefficients $g_L(t)$ and samples of the digital external microphone signal $s_E(t)$, i.e. directly carrying out the convolution operation specified by equation (9a) above:

$$y_L(t)=g_L(t)\otimes s_E(t)$$

The left hearing instrument 200 additionally comprises the previously discussed miniature receiver or loudspeaker 211 which converts the hearing loss compensated output signal produced by the signal processor 208 to audible sound for transmission to the hearing impaired person's ear drum. The signal processor 208 may comprise a suitable output amplifier, e.g. a class D amplifier, for driving the miniature receiver or loudspeaker 211.

The skilled person will understand that feature and functions of a right ear hearing instrument may be identical to the above-discussed features and functions of the left hearing instrument 200 to produce a binaural signal to the hearing aid user.

The optional mixing between the first synthesized microphone signal $y_L(t)$ and the first hearing aid microphone signal $s_L(t)$ in a first ratio and the similar and optional mixing between the second synthesized microphone signal $y_R(t)$ and the second hearing aid microphone signal $s_R(t)$ in a second ratio, to produce the left and right hearing loss compensated output signal $z_{L,R}(t)$, respectively, is preferably carried out as discussed above, i.e. according to:

$$z_{L,R}(t)=bs_{L,R}(t)+(1-b)y_{L,R}(t) \quad (14)$$

The mixing coefficient b may either be a fixed value or may be user operated. The mixing coefficient b may alternatively be controlled by a separate algorithm which monitors the SNR by comparing the contribution of the target signal component measured by the external microphone present in the hearing aid microphone signals and comparing the level of the target signal component to the noise component. When the SNR s high, b would go to 1, and when the SNR is low, b would approach 0.

Although particular features have been shown and described, it will be understood that they are not intended to limit the claimed invention, and it will be made obvious to those skilled in the art that various changes and modifications may be made without departing from the spirit and scope of the claimed invention. The specification and drawings are, accordingly to be regarded in an illustrative rather than restrictive sense. The claimed invention is intended to cover all alternatives, modifications and equivalents.

The invention claimed is:

1. A method of superimposing spatial auditory cues to an externally picked-up sound signal in a hearing instrument, comprising:

receiving, via a first wireless communication link, an external microphone signal from an external microphone placed in a sound field, wherein the act of receiving is performed using a wireless receiver of a first hearing instrument;

generating a first hearing aid microphone signal by a microphone system of the first hearing instrument, wherein the first hearing instrument is placed at, or in, a left ear or a right ear of a user;

determining a response characteristic of a first spatial synthesis filter by correlating the external microphone signal and the first hearing aid microphone signal; and filtering, in the first hearing instrument, the received external microphone signal by the first spatial synthesis filter to produce a first synthesized microphone signal comprising first spatial auditory cues.

2. The method of claim 1, further comprising:

processing the first synthesized microphone signal by a first signal processor according to individual hearing loss data of the user to produce a first hearing loss compensated output signal of the first hearing instrument; and presenting the first hearing loss compensated output signal to the user's left ear or right ear through a first output transducer.

3. The method of claim 1, further comprising:

receiving, via a second wireless communication link, the external microphone signal, wherein the act of receiving the external microphone signal via the second wireless communication link is performed using a wireless receiver of a second hearing instrument;

generating a second hearing aid microphone signal by a microphone system of the second hearing instrument when the external microphone signal is received by the second hearing instrument, wherein the first hearing instrument and the second hearing instrument are placed at, or in, the left ear and the right ear, respectively, or vice versa;

determining a response characteristic of a second spatial synthesis filter by correlating the external microphone signal and the second hearing aid microphone signal; and filtering, in the second hearing instrument, the received external microphone signal by the second spatial synthesis filter to produce a second synthesized microphone signal comprising second spatial auditory cues.

4. The method of claim 2, wherein the act of processing the first synthesized microphone signal comprises mixing the first synthesized microphone signal and the first hearing aid microphone signal in a first ratio to produce the hearing loss compensated output signal.

5. The method of claim 4, further comprising varying the ratio between the first synthesized microphone signal and the first hearing aid microphone signal in dependence of a signal to noise ratio.

6. A method of superimposing spatial auditory cues to an externally picked-up sound signal in a hearing instrument, comprising:

receiving, via a first wireless communication link, an external microphone signal from an external microphone placed in a sound field, wherein the act of receiving is performed using a wireless receiver of a first hearing instrument;

generating a first hearing aid microphone signal by a microphone system of the first hearing instrument, wherein the first hearing instrument is placed at, or in, a left ear or a right ear of a user;

determining a response characteristic of a first spatial synthesis filter by correlating the external microphone signal and the first hearing aid microphone signal; and filtering, in the first hearing instrument, the received external microphone signal by the first spatial synthesis filter to produce a first synthesized microphone signal comprising first spatial auditory cues;

wherein the act of determining the response characteristic comprises:

cross-correlating the external microphone signal and the first hearing aid microphone signal to determine a time delay between the external microphone signal and the first hearing aid microphone signal;

determining a level difference between the external microphone signal and the first hearing aid microphone signal based on a result from the act of cross-correlating; and determining the response characteristic of the first spatial synthesis filter by multiplying the determined time delay and the determined level difference.

7. The method of claim 6, wherein:

the act of cross-correlating the external microphone signal and the first hearing aid microphone signal comprises determining $r_L(t)$ according to:

$$\tau_L(t)=s_E(t)\otimes s_L(-t)$$

wherein $s_E(t)$ represents the external microphone signal, and $s_L(t)$ represents the first hearing aid microphone signal;

the time delay between the external microphone signal and the first hearing aid microphone signal is determined according to:

$$\tau_L=\text{argmax}_t r_L(t),$$

wherein $\tau_L$ represents the time delay;

the act of determining the level difference between the external microphone signal $s_E(t)$ and the first hearing aid microphone signal $s_L(t)$ is performed according to:

$$A_L=\sqrt{\frac{E[|r_L(t)|^2]}{E[|s_E(t)\otimes s_E(-t)|^2]}};$$

wherein $A_L$ represents the level difference; and wherein the act of determining the response characteristic comprises determining an impulse response $g_L(t)$ of the first spatial synthesis filter according to:

$$g_L(t)=A_L\delta(t-\tau_L).$$

8. The method of claim 1, wherein the first synthesized microphone signal is produced also by convolving the external microphone signal with an impulse response of the first spatial synthesis filter.

9. The method of claim 1, wherein the act of determining the response characteristic comprises:

determining an impulse response $g_L(t)$ of the first spatial synthesis filter according to:

$$g_L(t)=\underset{g(t)}{\text{argmin}}E[|g(t)\otimes s_E(t)-s_L(t)|^2]$$

wherein $g_L(t)$ represents the impulse response of the first spatial synthesis filter, $s_E(t)$ represents the external microphone signal, and $s_L(t)$ represents the first hearing aid microphone signal.

10. The method of claim 1, further comprising:

subtracting the first synthesized microphone signal from the first hearing aid microphone signal to produce an error signal; and determining a filter coefficient for the first adaptive filter according to a predetermined adaptive algorithm to minimize the error signal.

11. The method of claim 1, wherein the first hearing aid microphone signal is generated by the microphone system of the first hearing instrument when the external microphone signal is received from the external microphone.

12. A hearing aid system comprising:

a first hearing instrument; and a portable external microphone unit;

wherein the portable external microphone unit comprises:

a microphone for placement in a sound field and for generating an external microphone signal, and a first wireless transmitter configured to transmit the external microphone signal via a first wireless communication link; and wherein the first hearing instrument comprises:

a hearing aid housing or shell configured for placement at, or in, a a left ear or a right ear of a user, a first wireless receiver configured for receiving the external microphone signal via the first wireless communication link, a first hearing aid microphone configured for generating a first hearing aid microphone signal in response to sound when the external microphone signal is being received by the first wireless receiver, and a first signal processor configured to determine a response characteristic of a first spatial synthesis filter by correlating the external microphone signal and the first hearing aid microphone signal, wherein the first spatial synthesis filter is configured to filter the received external microphone signal to produce a first synthesized microphone signal comprising first spatial auditory cues.

13. The hearing aid system of claim 12, further comprising a second hearing instrument, wherein said second hearing instrument comprises:

a second hearing aid housing or shell, a second wireless receiver configured for receiving the external microphone signal via a second wireless communication link, a second hearing aid microphone configured for generating a second hearing aid microphone signal when the external microphone signal is being received by the second wireless receiver, and a second signal processor configured to determine a response characteristic of a second spatial synthesis filter based on the external microphone signal and the second hearing aid microphone signal, wherein the second spatial synthesis filter is configured to filter the received external microphone signal to produce a second synthesized microphone signal comprising second spatial auditory cues.

14. The method of claim 1, wherein the response characteristic of the first spatial synthesis filter is determined without using a second hearing aid microphone signal from a second hearing instrument.

15. The method of claim 1, wherein the response characteristic of the first spatial synthesis filter comprises a frequency response or an impulse response.

16. The method of claim 1, wherein the response characteristic of the first spatial synthesis filter is determined without using a binaural communication between the first hearing instrument and a second hearing instrument.

17. The hearing aid system of claim 12, wherein the first signal processor is configured to determine the response characteristic of the first spatial synthesis filter without using a second hearing aid microphone signal from a second hearing instrument.

18. The hearing aid system of claim 12, wherein the response characteristic of the first spatial synthesis filter comprises a frequency response or an impulse response.

19. The hearing aid system of claim 12, wherein the first signal processor is configured to determine the response characteristic of the first spatial synthesis filter without using a binaural communication between the first hearing instrument and a second hearing instrument.

* * * * *